United States Patent [19]

Klaus et al.

[11] Patent Number: 4,572,419

[45] Date of Patent: Feb. 25, 1986

[54] STAPLING TOOL

[75] Inventors: Artur F. Klaus, Frankfurt am Main; Gottfried Piecha, Neu-Anspach, both of Fed. Rep. of Germany

[73] Assignee: Signode Corporation, Glenview, Ill.

[21] Appl. No.: 542,160

[22] Filed: Oct. 14, 1983

[30] Foreign Application Priority Data

Oct. 23, 1982 [DE] Fed. Rep. of Germany ..... 3239256

[51] Int. Cl.[4] ..... B25C 1/06; B27F 7/11

[52] U.S. Cl. ..... 227/8; 227/131; 227/120; 227/155; 227/153

[58] Field of Search ..... 227/8, 124, 144, 131, 227/155, 156, 153

[56] References Cited

U.S. PATENT DOCUMENTS 2,943,327 7/1960 Juilfs ..... 227/124 X
3,580,458 5/1971 Monacells ..... 227/124
3,786,978 1/1974 Manganaru ..... 227/8
4,199,095 4/1980 Yamanoi ..... 227/155 X

FOREIGN PATENT DOCUMENTS 1724422 2/1953 Fed. Rep. of Germany .
1905532 8/1964 Fed. Rep. of Germany .
2812979 12/1981 Fed. Rep. of Germany .

*Primary Examiner*—Paul A. Bell
*Attorney, Agent, or Firm*—Dressler, Goldsmith, Shore, Sutker & Milnamow, Ltd.

[57] ABSTRACT

A stapling tool which includes an anvil assembly that is pivotally mounted and which can be positioned to secure items together through which a staple received from a magazine assembly is driven. The tool is trigger-operated and sequentially positions the anvil assembly to retain the items, after which a motor is actuated to drive the staple to connect the items. Following the driving action, the anvil assembly is removed to permit assembly of the connected items.

13 Claims, 6 Drawing Figures

STAPLING TOOL

The present invention is concerned with a stapling tool for driving and closing of staples disposed in a magazine of a tool body provided with a pivotable anvil and having a housing, which magazine includes a guiding channel for the respectively foremost staple disposed in the magazine of a number of staples adapted to be moved up, that is movable by a drive blade through the guide channel against a slotted plate carried by the anvil, while guiding plate and anvil in their operating position are pivoted toward one another.

Stapling tools of the aforementioned type are being used, for example, in the textile industry for the fastening of price tags on articles of clothing. The price tags can be easily connected to the respective garment and, if need be, removed therefrom. In price labelling major stocks, for example, in department stores, or the like, one person will have to perform up to several thousands of staplings per day on clothing articles hanging on racks. The frequent actuation of the stapling tool causes symptoms of fatigue, especially the hand will grow weary that exerts the force required for driving forward and bending the staples. Due to those symptoms of fatigue, frequently, incomplete staplings are performed, with the legs of the U-shaped staples not being entirely bent. In such events, the price tickets are not reliably secured to the clothings and are likely to drop. The upstanding staple legs, moreover, are liable to cause injury.

To reduce fatigue, it is possible to use electrically driven stapling tools. In such prior known tools, the driving blade displacing the foremost staple in the magazine through a guiding channel against the slotted plate of the anvil is driven by a holding-on magnet. In such a drive by a holding-on magnet, a blow is exerted on the staple. The blow-type operation is unfavorable to the stapling process in which the legs of the staples are to close gradually by bending. The blows, moreover, are transferred to the hand holding the stapling tool, thereby heavily straining the wrist of the operator.

Basic to the invention is, therefore, the problem of improving a stapling tool of the aforementioned type in a manner that with the least possible repercussion upon the person operating the stapling tool, the staples be reliably fastened, i.e., the legs of the staples be respectively bent completely with effortless ease and a low energy expenditure.

That problem in accordance with the invention is solved in that connected to the rotor of an electromotor is a crank drive operating the driver blade and that through a pivotally disposed push lever locking mechanism, on the one hand, the anvil is relatively pivotal to the tool body into the operating position thereof and is adapted to be locked in that position and, on the other hand, the electromotor is adapted to be turned on and lockable in the "on" position, and that through a cam plate rotatable by the rotor the electromotor only upon each complete rotation of the crank drive can be turned off and the anvil unlocked. The masses to be displaced during the respective stapling operation in a forward and rearward movement in this apparatus are low-volumed. The forces caused by the mass acceleration and deceleration during a stapling operation and transferred to the operator's hand are, therefore, equally low. Besides, driving and bending of the staples takes place at a speed dependent on the rotational speed of the electromotor. Via a corresponding speed of the crank drive, the speed of the staple feed can be easily adapted to the conditions required for a favorable and safe bending. Operation and handling of the stapling tool with the inventive measures as oulined does not involve any difficulties. It has been safeguarded that the electromotor will be turned off and the working position of the anvil over the tool body will be unlocked only upon performance of a complete turn of the electromotor and after the staple having thus been completely driven out by the driver blade against the slotted plate of the anvil. The tool of the invention, therefore, permits only complete staplings with a simple and easy operation requiring only little effort on the part of the operator.

In an advantageous embodiment of the inventive conception, the cam plate, during rotation, acts upon a lever of a pivot shaft extending preferably in parallel to the axis of rotation of the cam plate, which pivot shaft, in turn, with an actuating projection, operates in the sense of unlocking the push-lever locking mechanism and hence switching off the electromotor. In this manner, a simple, reliable and room-saving structure is attained that is equal to the rugged operation of such stapling tools.

The push-lever locking mechanism, on the one hand, can be pivoted to the anvil and, on the other hand, can be pivoted to the housing.

Preferably, the push-lever locking mechanism comprises a push lever and a pivot lever that are pivotally interconnected via a common pivot axis and in their starting position are disposed at an expanding angle with respect to one another, with the pivot lever with the free end thereof directly or indirectly being pivoted to the anvil and the push lever with the free end thereof directly or indirectly being pivoted to the housing, and with a switch head upon actuation thereof in the sense of enlarging the expanding angle between the push lever and pivot lever acting upon the push lever and/or pivot lever. A simple actuating mechanism for releasing the stapling operation is attained thereby.

In a special form of embodiment of the conception of the invention, it can, however, be provided that a rack is pivoted to the joint connection between the push lever and the pivot lever, or one of the two levers and that, upon actuation of the switch head, the rack, preferably against the action of a spring, by a longitudinal displacement, is engageable by a locking tooth that for unlocking purposes is pivotable about an axis from the displacement plane of the rack. Upo the operation of the switch head, e.g., by hand, the anvil via the push-lever locking mechanism not only is placed into its operating position, but is rather also locked in that position. The locking takes place preferably against the action of a spring if a restoring force is to become effective during unlocking.

The locking tooth can be provided, for example, on a bracket pivotable about the axis, preferably against the action of a spring that is connected to contact the lever acting upon a microswitch disposed in the current supply for the electromotor, for the purposes of joint pivoting. Upon the operation of the switch head, thus not only the anvil is placed into its working position and locked therein, but at the same time, the electromotor is turned off and locked in that position. Pivoting of the bracket against the action of a spring is then provided when the microswitch is automatically to be released again with the unlocking operation.

The unlocking of anvil and electromotor only after at least one complete turn of the driving shaft of the electromotor and hence the complete forcing out of the staple in simple manner is attained in that in another advantageous embodiment, the actuating lug of the pivot shaft acts upon a tongue of the contact lever for pivoting the same and hence the bracket thereby unlocking both the microswitch and the rack.

If according to another embodiment of the invention the contact lever, preferably against the action of a spring, is displaceable via a displacement lever operable by the push lever along the axis toward the microswitch, the contact lever not only is able to perform a lateral pivot movement for operating the microswitch, but rather also a longitudinal movement in the perpendicular direction toward the microswitch.

It is especially advantageous if a restoring spring so acts upon push lever and pivot lever that during restoring the expanding angle between push lever and pivot lever automatically is decreased. In this manner, during unlocking of the rack, the anvil is also automatically placed into its pivoted initial resting position.

Push lever and pivot lever can be displaceably disposed in a common oblong hole in the housing. In this manner, the previously mentioned longitudinal displacement of the contact lever over the microswitch is realizable in a simple manner. A practical arrangement of the rack on the housing body is attained if the rack with an oblong hole is displaceably disposed on a pin of the housing.

For the simple and safe actuation of the microswitch, it might be practical if the contact lever comprises an L-shaped angle provided on the axis, with the one end of said angle being applicable against a push key of the microswitch.

The guided movement of the driver blade in the system of the invention can be performed, for example in that the crank drive comprises a pin plate including an eccentric pin that is secured to a drive shaft of the electromotor, which drive shaft carries the cam plate.

Feasibly, the pin engages a transverse slot of the driver blade guided toward the slotted plate of the anvil.

It is advantageous of the way of operation of the stapling system if a reduction gear, e.g., of plastic material, is coupled to the electromotor.

In another advantageous embodiment of the inventive conception, the microswitch has a switch-over contact and the winding of the electromotor in the off position is short-circuited via the switch-over contact. In this manner, it is possible for the electromotor to stand still immediately after completion of a complete turn of the drive shaft and hence of the cam plate.

It is particularly advantageous for the handling of the stapling system if the tool body and the appertaining housing are gun-shaped, with the switch button being provided in the handle. In that case, the direction of the actuating force, advantageously, is approximately normal to the path of guidance of the staples, which facilitates the actuation of the stapling system.

A compact construction of the tool is attained if the push-lever locking mechanism is provided in the handle of the housing.

The safe disengagement of the anvil and electromotor only after a complete turn of the driving shaft is achieved if the cam plate, under the tension of a spring, is adapted to be forced into an end position on the driving shaft in which a driver pin engages the driving shaft.

Further objects, features, advantages and fields of application of the present invention arise from the following description of examples of embodiment by way of the enclosed drawing. All features described and/or illustrated by themselves, or in any desired meaningful combination, form the subject matter of the present invention irrespective of their being summarized in the claims or their dependencies.

Figure 1:
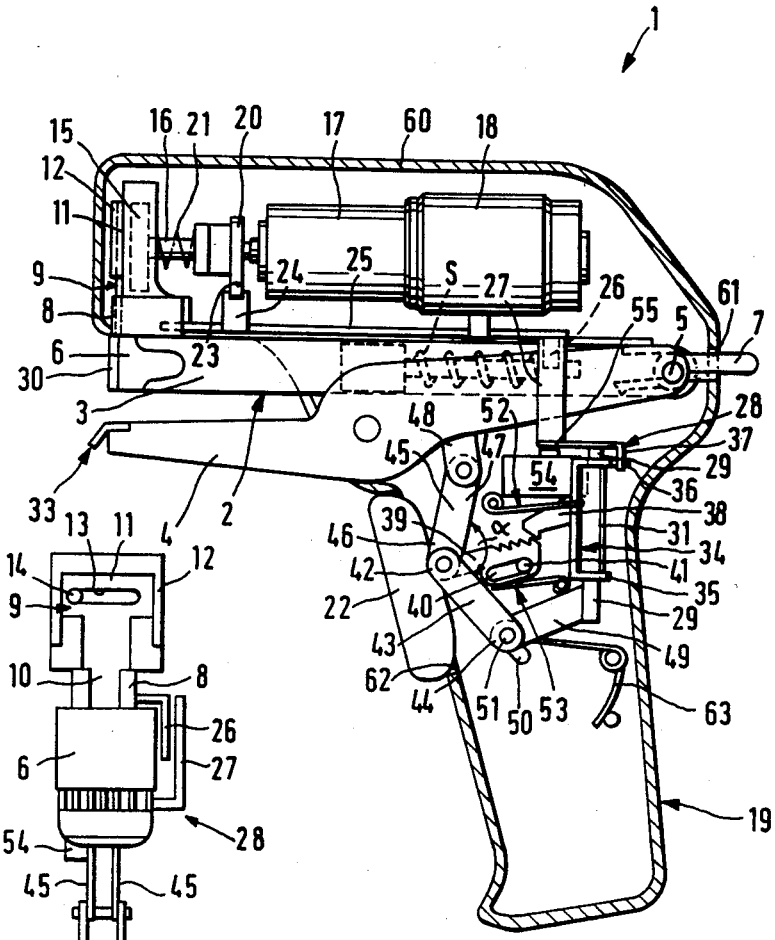
FIG. 1 is a schematic side view of a stapling tool with the housing broken away.
Figure 3:
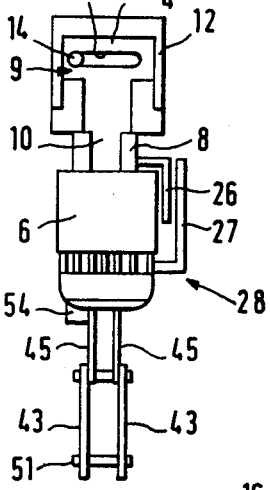
FIG. 3 is a schematic front view of a stapling tool showing only the essential components thereof without a housing.
Figure 2:
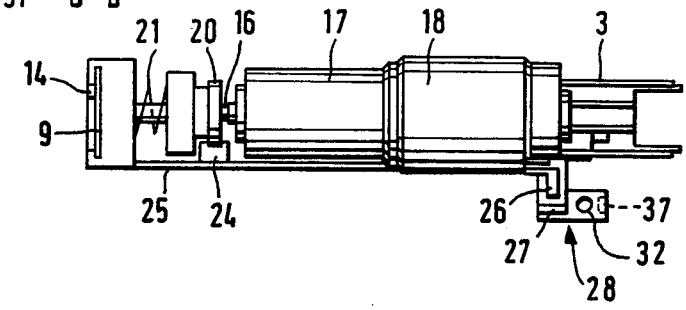
FIG. 2 is a schematic plan view of a stapling system showing only the essential components thereof without a housing.
Figure 4:
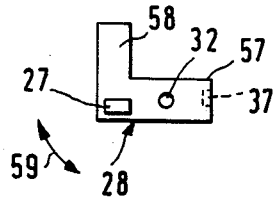
FIG. 4 is a top view of a contact lever of the stapling tool illustrated in FIG. 1.
Figure 5:
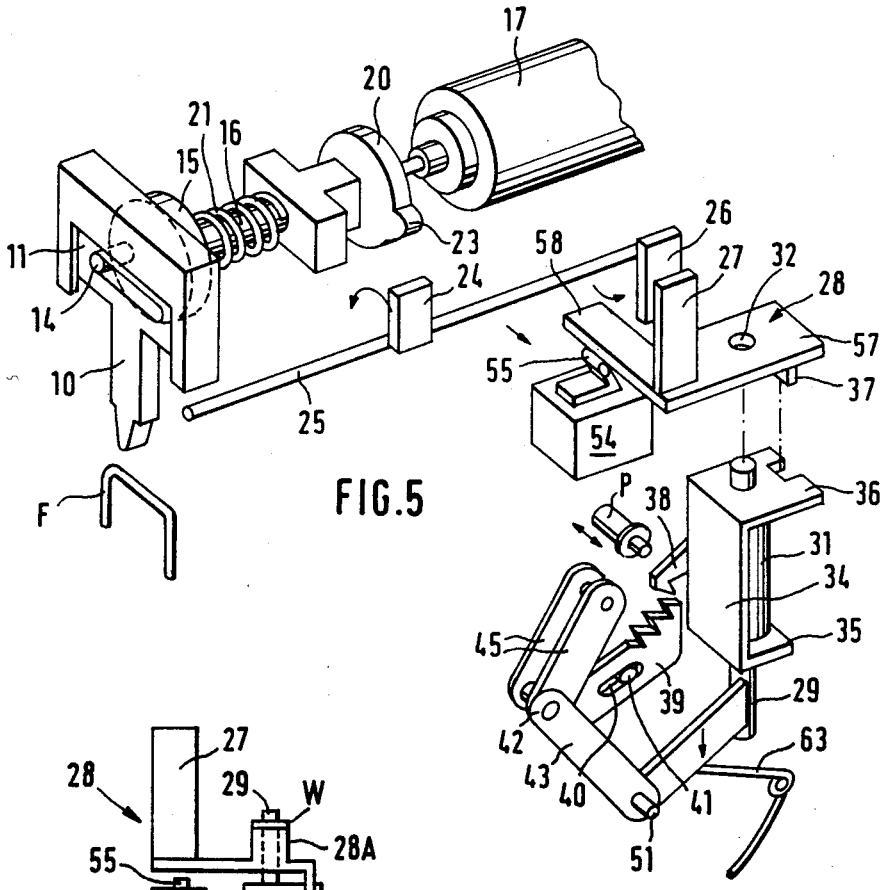
FIG. 5 is an exploded perspective view showing the main operating components of the tool.

The various mechanisms embodied in the tool are shown in elevation in FIGS. 1–4 and in perspective in the exploded form in FIG. 5.

A stapling system 1 for driving of U-shaped staples and for bending the legs of the staples includes a tool body 2 comprising a housing 60, provided with a housing 3 in which is contained a magazine 6 for receiving a supply of staples. Disposed in housing 60 is an elongated anvil 4 with the rear end thereof pivotable about an axis 5. Anvil 4 at the front end thereof carries a slotted anvil plate 33.

Magazine 6 can be inserted into housing 3 against action of a spring-biased detachable pawl 7. The staples in magazine 6 are forced by a spring S towards a vertical guide channel provided at the front end of magazine 6. The foremost staple (see F in FIG. 5) from the staple supply in the magazine 6 is, therefore, always in the guide channel 30.

Disposed above the guide channel 30 is an assembly 8 having a guide for a driver blade 9 disposed immediately above the guide channel 30. The driver blade is received in a vertically displaceable manner in assembly 8. As shown in FIG. 3, driver blade 9 is of a T-shaped configuration. In central part 10 thereof, driver blade 9 is so guided in assembly 8 that in downward movement with the bottom edge thereof it directly strikes the stem of a staple disposed therebelow. The upper transverse portion 11 of driver blade 9 is displaceable in a broad guide 12 of housing 60. Provided in that transverse portion 11 is a slot 13 extending transversely of the direction of displacement of the driver blade 9 which slot 13 is engaged by a pin 14 eccentrically securedto a pin plate 15. Pin 14, for this purpose, extends from the front side of the pin plate 15 in axial direction through the transverse slot 13. Pin plate 15 is flyingly disposed on a drive shaft 16. The drive shaft 16 is the starting shaft of a reduction gear 17 flanged to an electromotor 18 which, in turn, is received in housing 60.

A cam plate 20 is non-rotationally disposed on drive shaft 16. Cam plate 20 is forced by spring 21, the one end of which is supported by pin plate 15, against the end of shaft 16 projecting out of gear 17. A driving pin connected to cam plate 20 engages a recess of shaft 16. Cam plate 20 on the outer circumference thereof carries a cam 23 that engages a lever 24 secured to a pivot shaft 25 extending in parallel to driving shaft 16. The circumferential position of cam 23 of cam plate 20 is variable by the driving pin.

Pivot shaft 25 is disposed and rotatably supported in housing 60. The rear end of pivot shaft 25 carries an actuating lug 26 that projects normal to the central axis of the pivot shaft 25.

The actuating lug 26 cooperates with a tongue 27 that projects perpendicularly from an L-shaped angle 28 (see FIG. 4). L-shaped angle 28 is located on a perpendicular pin 29. Tongue 27 with angle 28 forms a contact lever. Angle 28 consists, for example, of plastic material. The plane of angle 28 extends normal to pin 29 that extends in the central plane of tool body 2 or in parallel thereto. Pin 29 in its central section is received by a bearing 31 of housing 60.

Pivotally disposed on pin 29 is a U-shaped bracket 34, legs 35,36 of which embrace pin 29 at both ends of bearing 31 in housing 60. Upper leg 36 bifurcates, with a tang 37 perpendicularly bent downwardly away from angle 28 engaging the interval between the bifurcated spikes. The contact lever 27,28 and bracket 34 are thereby jointly pivotable about pin 29. Pin 29 is received non-rotationally but axially displaceable in bearing 31. Bracket 34 is pivotable by a predetermined angle of rotation about pin 29, with the bifurcated leg 36 entraining tang 37 of angle 28. Secured to bracket 34 is an arresting tooth 38 protruding outwardly from the side of bracket 34 remote from the space defined by legs 35,36. Arresting tooth 38 cooperates with a rack 39 having an oblong hole 40 engaged by a pin 41 provided on housing 60. Pin 41 protrudes perpendicularly away from the central plane of housing 60.

The end of rack 39 remote from the arresting tooth 38 together with an end 42 of a push lever 43 is pivoted in housing 60. The other end 44 of push lever 43 is equally pivotably disposed in housing 60. In the area of end 42 of push lever 43, moreover, a pivot lever 45 with end 46 thereof is pivotably disposed in housing 60. The other end 47 of pivot lever 45 is pivotably disposed on projection 48 of anvil 4. Rigidly secured to the bottom end of pin 29 is a displacing lever 49, the free end of which together with end 44 of push lever 43, with the aid of pin 51, is disposed in an oblong hole 50 in housing 60. Oblong hole 50 extends over a small distance almost parallel to pin 29.

The restoring force of a spring 52 fixed relative to housing 60 acts upon U-shaped bracket 34. Spring 52 forces bracket 34 into a position such that arresting tooth 38 lies in the same plane as rack 39. Spring 53 forces push lever 43 by acting obliquely from the bottom upon rack 39 which is thereby forced into the arresting position relative to arresting tooth 38 outwardly, so that in the starting position, push lever 43 and pivot lever 45 enclose as small an expanding angle $\alpha$ as possible. Moreover, a spring 63 acts from the bottom onto displacing lever 49 which spring tends to force pin 29 upwardly.

Push lever 43 and pivot lever 45 may, respectively, comprise a pair of levers disposed symmetrically to the central plane of housing 60. Such an embodiment of push lever 43 and pivot lever 45 is shown in FIG. 3.

A microswitch 54 having a push key 55 is in such a position that angle 28 is pivotable above the push key and engageable by the same if rack 39 is in its arresting position, i.e., pin 29 is in its lower position and bracket 34 holds a position in which arresting tooth 38 is in its arresting position. Upon rotation of angle 28 about pin 29, one end of angle 28 protrudes beyond push key 55. Angle 28 has two end positions. The one end position is determined by abutment of arresting tooth 38 in the central position of housing 60. In that end position, the free end of angle 28 is in the area of push key 55. The other end position of angle 28 is determined by the deflection of actuating lug 26 which upon actuation of lever 24 through cam 23 of cam plate 20 is deflected by a predetermined angle and abuts tongue 27. Via tongue 27, angle 28 is pivoted into its second end position in which arresting tooth 38 is pivoted from the plane of rack 39 for the purposes of disengagement. Through pivoting angle 28, at the same time, the end thereof is removed from the area of the push key 55, i.e., electromotor 18 is turned off.

FIG. 4, individually, shows angle 28, viewed from the top. Tongue 27 from angle 28 protrudes perpendicularly upwardly. Angle 28 has two ends 57,58. From end 57, tang 37 protrudes perpendicularly downwardly. Pin 29 with the top end thereof may engage a recess 32. The pivot movement of angle 28 is shown in FIG. 4 by arrow 59. End 58 serves to actuate push key 55.

Figure 6:
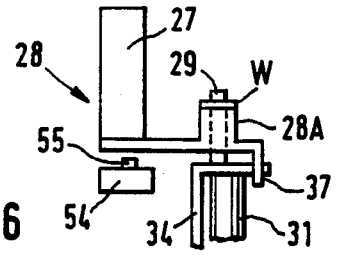
FIG. 6 is a view illustrating the connection between the plate 28 and pin 29.

As indicated in FIG. 6, the pin 29 has a washer W secured thereto which contacts a boss 28A of the angle 28 to move the end 58 of angle 28 downward to contact push key 55.

Housing 60 includes a rearward recess 61 through which the end of pawl 7 protrudes. Housing 60 permits magazine 6 to be pulled out of housing 3 forwardly so that both magazine 6 and the guide of driver blade 9 in assembly 8 are readily accessible, which is important in case a staple is blocked. Below anvil 4, in the area of handle 19, housing 60 includes a recess 62 through which a switch head 22 protrudes which with the rearside thereof acts upon push lever 43 and pivot lever 45, respectively, or on the pin interconnecting the two levers 43 and 45.

In order to apply a staple, the material to be stapled is inserted between anvil 4 and housing 3. Anvil 4 takes the pivoting position shown in FIG. 1. In the material to be stapled it can, for example, be a question of a piece of clothing and a price tag jointly pushed into the area between the slotted anvil plate 33 and the guide channel 30.

For releasing the stapling operation, the switch head 22 is pressed down by the fingers of the operator's hand holding handle 19 of the gun-shaped housing 60. Trigger 22 thereby acts upon push lever 43 and the pivot lever 45 to the effect of enlarging angle enclosed thereby. Previously, pin 29 on account of the action of spring 63, was in its upwardly projecting position. Rack 39 in its outermost position, is disengaged from arresting tooth 38. Cam tooth 38 itself on account of the action of spring 52 is in the same plane as rack 39. Bracket 34, together with angle 28, takes such a position that end 58 is directly above push key 55. When pressing down trigger 22, on the one hand, rack 39 against the action of spring 53, is forced relative to pin 41 into its arresting position along with arresting tooth 38. The width of oblong hole 40 is so dimensioned that rack 39 with the teeth thereof over the arresting tooth 38, against the action of spring 53, can slightly escape downwardly. As soon as rack 39 has covered the required distance, arresting tooth 38 engages the teeth of rack 39. Due to the enlargement of the expanding angle between push lever 43 and pivot lever 45, anvil 4, on the other hand, is pivoted upwardly until it abuts housing 3 while putting therebetween the material to be stapled. In that end position, anvil 4 locks rack 39 by tooth 38. The position of anvil 4 is thus locked for the stapling operation. Simultaneously with the spreading apart of the push lever 43 and the pivot lever 45 the bottom end 44 of the push lever 43 with axis 51 in oblong hole 50 moves downwardly. Also displacing lever 49 and pin 29 are pushed downwardly thereby. Angle 28 is equally moved downwardly thereby and, with end 58 thereof, presses down push key 55. A reflector switch disposed in microswitch 54 is actuated thereby. By actuating the selector switch (not shown), electromotor 18 is Connected to voltage and starts to rotate. The rotation is transferred via gear 17 to drive shaft 16. Pin plate 15 connected to drive shaft 16 performs a rotational movement that via pin 14 exerts upon the driver blade 9 a linear displacement movement first downwardly and the upwardly again. Driver blade 9 pushes a staple through guide channel 30 and through the material to be stapled to the slotted anvil 33, with the legs of the staples after penetration of the material into the slot of the slotted plate 33 being bent together.

Driving shaft 26 during rotation also entrains cam plate 20. Cam 23 of cam plate 20 with regard to its angular position is so adjusted that first an almost complete turn of the drive shaft 16 is performed before cam 23 actuates lever 24. During that rotation, driver blade 9 performs a complete stapling operation and returns to its approximate starting position. By actuating lever 24 lug 26 is deflected via pivot shaft 25. Actuating lug 26 exerts upon tongue 27 a pivot movement about pin 29. On account of that pivot movement, end 58 of angle 28 is removed from push key 55 of microswitch 54, which, in turn, changes over into its other end position. In that end position, the winding of electromotor 18 is short circuited in order to attain as brief a braking distance as possible, just to the full turn of the driving shaft 16. Moreover, through the pivot movement of angle 28, also bracket 34 is pivoted, thereby unlatching arresting tooth 38 against the action of spring 52 from its engagement with rack 39. This means that also anvil 4 is unlocked, so that anvil 4 returns into its starting position. The return of anvil 4 into its starting position can be supported by a spring (not shown) that is additionally effective between housing 3 and anvil 4. Spring 63 moves push lever 43, pivot lever 45, and hence the trigger 22 back into its starting position. Rack 39 thereby displaces from the engagement range of arresting tooth 38 which despite the action of restoring spring 52 can no longer engage rack 39. Spring 52 moves bracket 34 and hence angle 28 back into its starting position. Accordingly, stapling unit 1 is available for another stapling operation after a complete stapling operation and nothing but a complete stapling operation has been performed.

It remains to note that as shown in FIG. 5, a push button assembly P is provided for resetting the tool to return it to its starting position. Specifically, operation of the push button P engages the tooth 38 to separate it from the rack 39 without rotation of the motor 18. Separation of the tooth 38 from rack 39 results in the levers 43,45 moving towards each other to move the anvil 4 away from the housing 3.

It is intended to cover by the appended claims all such embodiments and modifications that fall within the true spirit and scope of the invention.

What is claimed is:

1. A fastener driving tool comprising a housing assembly including a support means, a fastener magazine assembly mounted in said housing assembly, an anvil assembly pivotally mounted relative to said housing assembly adjacent to said magazine assembly, a reciprocably mounted driver blade disposed in guide means defined by said housing assembly for engaging a fastener in said magazine and driving the fastener to connect a plurality of materials disposed between the anvil and said magazine, means for positioning said anvil assembly to retain a plurality of materials disposed between the magazine and said anvil assembly, motor means including a shaft connected to said driver blade for driving said driver blade and trigger responsive means for locking said anvil in its material retaining position and for actuating said motor means and thereafter releasing said anvil to permit removal of the secured plurality of materials located between said anvil and said magazine, said means for positioning said anvil assembly including a linkage assembly containing at least one pair of links interconnected by pin means with the opposite end of one of said links connected to said anvil and the end of the other link movably connected to the support member, and the trigger responsive means includes a trigger secured to said pin means, whereby actuation of said trigger will retain materials to be joined between the anvil and magazine.

2. A fastener driving tool as set forth in claim 1 in which the means for locking the anvil in its material retaining position includes rack and tooth members with one of said rack and tooth members being secured to said pin means and the other secured to said support means.

3. A fastener driving tool as set forth in claim 2 in which the rack is secured at one end to said pin means and its other end is secured to said support means through a lost motion mechanism.

4. A fastener driving tool as set forth in claim 3 including means for movably mounting the tooth member relative to said support means and for normally biasing said tooth member in position to lockingly engage with said rack to retain the anvil in the locked position when the trigger is actuated.

5. A fastener driving tool as set forth in claims 1, or 2 in which said trigger responsive means includes a switch for actuating said motor and means responsive to said linkage assembly for engaging said switch to activate said motor to move the driver blade to drive a fastener and means responsive to the completion of the movement of the driver blade through its driving action to de-energize said switch and disengage the locking means to release the anvil.

6. A fastener driving tool as set forth in claim 5 in which the last-mentioned means includes a cam operated mechanism which in response to one rotation of said motor shaft acts to disengage said switch and move said tooth out of engagement with said rack to unlock said linkage assembly and effect movement of the anvil away from the magazine assembly.

7. A fastener driving tool as set forth in claim 6 in which the cam operated mechanism includes a cam secured to the motor shaft, a rod assemblage rotatably mounted relative to said support assembly and positioned to be rotated by said cam and a pivotably mounted plate assembly which has been moved to the switch engaging position by said trigger and is moved out of the switch engaging position by said rod assemblage.

8. A fastener driving tool comprising a housing assembly including a support means, an anvil assembly pivotally mounted relative to said support means, a motor operated reciprocably mounted driver blade, a fastener magazine assembly in said housing biasing a fastener into position adjacent said driver blade to be driven thereby, said housing and magazine assembly defining associated guide means for the driver blade, trigger responsive means for sequentially positioning said anvil assembly to retain the items to be joined between the anvil assembly and said guide means, actuating said motor means to move the driver blade to drive a fastener to connect said items, and releasing said anvil assembly to permit removal of said connected items, said trigger responsive means including a linkage assembly operated by a trigger, a locking mechanism actuated by movement of said linkage mechanism for securing the anvil in position comprising rack and tooth members where one of said rack and tooth members is secured to said linkage assembly and the other is movably mounted relative to said support means, and a release mechanism for disengaging said locking mechanism after a fastener has been driven.

9. A fastener driving tool as set forth in claim 8 in which the linkage assembly includes at least one pair of interconnected links, with the unconnected end of one of said links connected to said anvil and the unconnected end of the other of said links being movably connected to said support means, and means for biasing the unconnected ends of said links toward each other to space the anvil from said guide means.

10. A fastener driving tool as set forth in claim 9 in which the linkage assembly includes two pairs of links interconnected by pin means and said trigger and rack member is connected to said pin means, whereby actuation of said trigger moves said linkage assembly to move the anvil into position adjacent said guide means with materials to be connected positioned between said anvil and guide means and the rack member is moved into locking engagement with said tooth member to retain the anvil in a locked position.

11. A fastener driving tool as set forth in claim 10 in which said trigger responsive means includes a switch for actuating said motor, means responsive to said trigger for engaging said switch to energize the motor to move the driver blade to connect items disposed between the anvil and guide means, means responsive to movement of the motor to disengage the tooth from said rack to release the anvil from its locked position to permit removal of the items fastened together.

12. A fastener driving tool as set forth in claim 8 in which said trigger responsive means includes a switch for actuating said motor and means responsive to said trigger for engaging said switch to energize the motor to move the driver blade to connect items disposed between the anvil and guide means.

13. A fastener driving tool as set forth in claim 12 in which the motor includes a drive shaft on which is secured a cam and means responsive to engagement by said cam to disengage said switch after said fastener has been driven.

* * * * *